US005197258A

United States Patent [19]

Johanek

[11] Patent Number: 5,197,258

[45] Date of Patent: Mar. 30, 1993

[54] SCREWCAPPING DEVICE WITH TORQUE LIMITING MAGNETIC CLUTCH

[75] Inventor: Frank M. Johanek, Elm Grove, Wis.

[73] Assignee: Federal Manufacturing Co., Milwaukee, Wis.

[21] Appl. No.: 782,503

[22] Filed: Oct. 24, 1991

[51] Int. Cl.[5] ..... B65B 7/28

[52] U.S. Cl. ..... 53/317; 53/331.5

[58] Field of Search ..... 53/306, 317, 331.5, 53/343; 192/56 R, 84 PM; 464/29, 30

[56] References Cited

U.S. PATENT DOCUMENTS

| | | | |
|---|---|---|---|
| 2,309,548 | 1/1943 | Stover | 53/343 X |
| 3,964,240 | 6/1976 | Evrard | 53/317 X |
| 4,364,218 | 12/1982 | Obrist | 53/331.5 |
| 4,485,609 | 12/1984 | Kowal | 53/331.5 |
| 4,599,846 | 7/1986 | Ellis et al. | 53/331.5 |
| 4,633,646 | 1/1987 | Ellis et al. | 53/331.5 |
| 4,674,264 | 6/1987 | Ellis et al. | 53/331.5 |

*Primary Examiner*—John Sipos
*Assistant Examiner*—Daniel B. Moon
*Attorney, Agent, or Firm*—Fuller, Ryan, Hohenfeldt & Kees

[57] ABSTRACT

A clutch adapted for use in a screwcapping device to apply a preselected amount of torque to the driven component having a pair of axially aligned circular cylinders of equal diameter each having a generally smooth engaging surface facing the other clutch cylinder. Each of the cylinders has cavities in the rear side for containing magnets. The magnets are secured in the cavities by means of a cured polymeric resin. The maximum torque provided by the clutch is controlled by using removable spacer disks of varying thicknesses and having a diameter equal to that of the cylinders positioned between the engaging surfaces. The spacer may have a slot extending from the radius to the periphery adapted to be positioned on a central spindle passing through the cylinders.

13 Claims, 2 Drawing Sheets

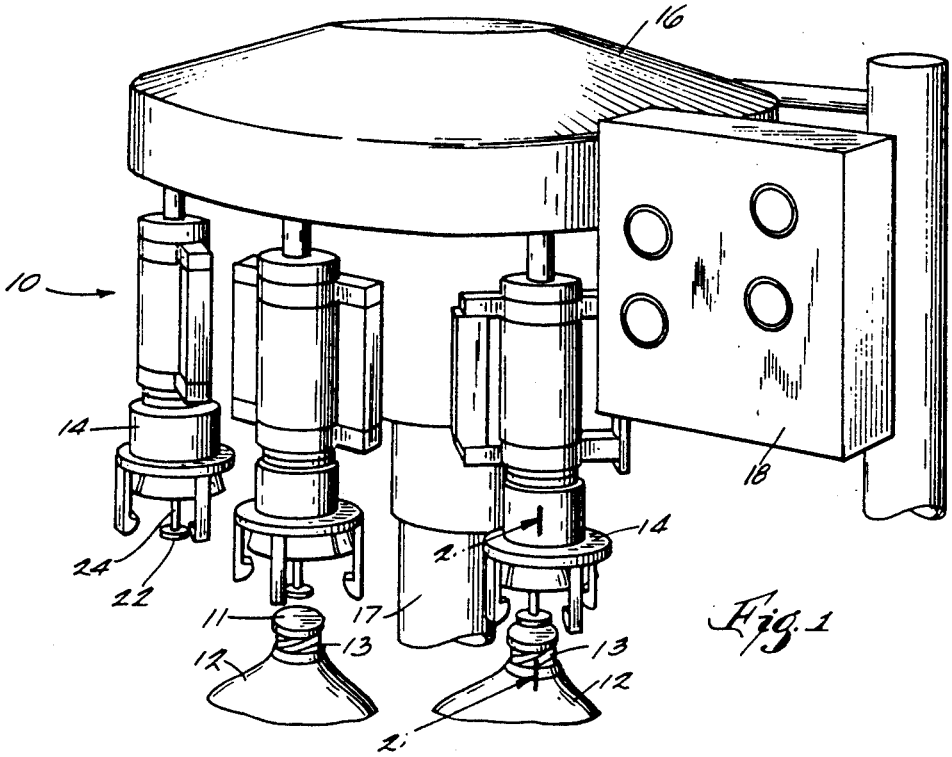
Fig. 1
Fig. 2
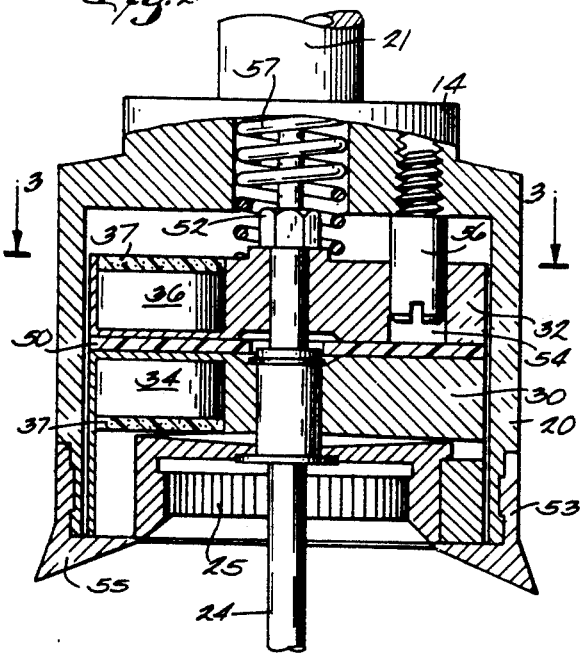
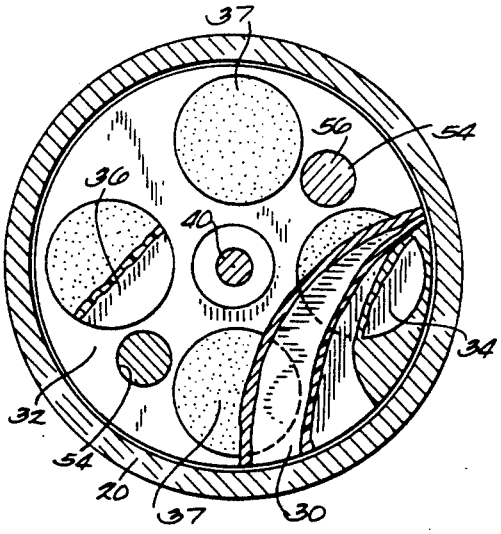
Fig. 3

SCREWCAPPING DEVICE WITH TORQUE LIMITING MAGNETIC CLUTCH

FIELD OF THE INVENTION

This invention relates to a screwcapping head for applying threaded caps to the threaded neck of a container. More particularly the invention relates to such a device utilizing an improved magnetic clutch to control the torque applied to such a closure.

BACKGROUND OF THE INVENTION

Various capping devices have heretofore been utilized for applying threaded caps to prethreaded containers. Such devices utilize a clutch to control the amount of torque applied so that the container is properly closed but also to prevent too much torque from being applied which could make the container too difficult to open or even strip the threads thereon Examples of such devices are shown in U.S. Pat. Nos. 3,964,240; 4,364,218; 4,485,609 and 4,674,264. The devices shown in the prior art have generally used rings of concentric magnets with some form of control device to control the axial position of those magnets. Various devices have also incorporated rings of magnets of alternating polarity Even though such devices have been available, they have tended to be complex and costly and thus many capping devices utilizing spring loaded mechanical and friction clutches are still in use; for example, in the dairy industry wherein threaded plastic bottles are generally closed by means of threaded closure caps. A need has thus continued to exist for such a device incorporating a simplified but effective clutch mechanism.

SUMMARY OF THE INVENTION

It is a principal object of the present invention to provide a capping device for threaded closures having a simple, economical magnetic clutch mechanism. A related object is to provide such a mechanism which eliminates the need for complex control mechanisms to control the maximum amount of torque provided by the clutch by governing the relative positions of the clutch components. A related aspect of the invention relates to providing such a clutch assembly which due to its compact configuration can be substituted in existing capping devices that employ mechanical clutches, thus making it possible to retrofit existing equipment without the need to replace the entire expensive cap tightening station of the machine.

A further aspect of the invention relates to providing a clutch mechanism having a smooth corrosion resistant configuration suitable for use in food processing plants. A still further aspect of the invention relates to providing such a clutch device having a compact configuration in which the spacing of the components is controlled by insertion and removal of corrosion resistant non-magnetic spacing devices. Another aspect of the invention is to provide a clutch in which the maximum torque is not affected by irregularities in the heights of the containers being capped or by the speed at which the bottles pass through the line.

Briefly summarized, the invention provides a screwcapping device having a clutch adapted to apply a preselected amount of torque to the driven component having a pair of axially aligned circular cylinders of equal diameter each having a generally smooth engaging surface facing the other clutch cylinder. Each of the cylinders has cavities in the rear side for containing magnets. The magnets are secured in the cavities by a means such as a cured organic polymer, a press fit plug, screwed closure or the like. The maximum torque provided by the clutch is controlled by using removable spacer disks of varying thicknesses between the driving cylinder and driven cylinder and positioned between the engaging surfaces. The spacers may each have a slot extending from the radius to the periphery adapted to be positioned on a central spindle passing through the cylinders. The magnets are positioned so that the north poles of the magnets in one of the cylinders faces the engaging surface of the clutch and the south poles of the magnets in the other cylinder faces the engaging surface. A mechanical spring is preferably provided to urge the driving cylinder downward in the screwcapping head.

BRIEF DESCRIPTION OF THE DRAWINGS

The invention will be further set forth in the following detailed description and accompanying drawings wherein:

FIG. 1 is a perspective view with parts broken away of a bottle capping station in a plant of the type employing clutches of the present invention, FIG. 2 is a cross-sectional view of a capping head of this invention taken along line 2—2 of FIGS. 1 and 3, FIG. 3 is a cross-sectional view taken along line 3—3 of FIG. 2.

DETAILED DESCRIPTION

Figure 5:
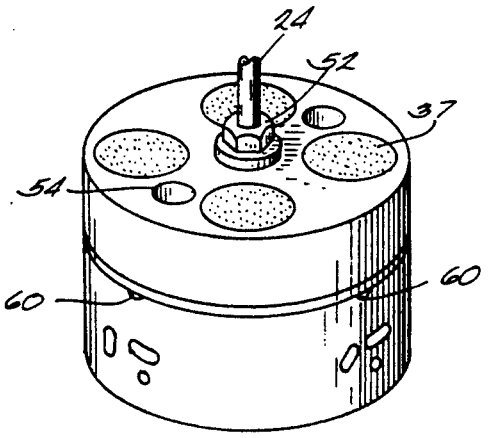
FIG. 5 is a perspective view of a clutch component of the present invention.

Referring more specifically to the drawings, there is seen in FIG. 1 a bottle capping station 10 in a bottle and filling line, of the type generally used in a food packaging or other container filling operation. A series of containers 12 having preformed screw threads adjacent the top opening thereof are conveyed through the line. Caps 11, usually loosely applied at a different station may be partially threaded onto threads 13. The bottle closure station 10 includes a series of screwcapping closure devices 14 arranged, for example, in a circular configuration, to successively receive each bottle in a line of containers being conveyed thereto. A mechanism 16 for rotatably supporting capping heads 14 and the support structure 17 and electrical control panel elements 18 are all of conventional design, do not form a direct part of the present invention, and are shown only for informational purposes.

A screwcapping head of this invention 14 includes a driving head including an annular housing 20 mounted on a rotatable driving shaft 21 driven by a motor (not shown). A bottle cap engaging plunger or platen 22 carried on a spindle 24 carried within housing 20 for limited axial movement is movable within bottle cap engaging component 25, also of conventional design. Bottle cap engaging component 25 bottle cap 11, in known fashion, when spindle 24 moves upwardly.

Figure 6:
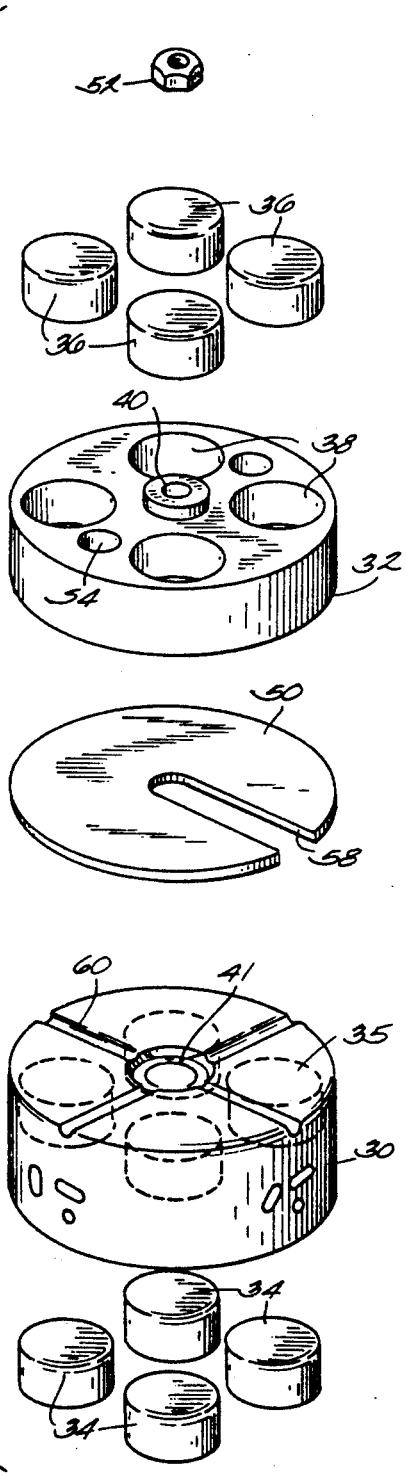
FIG. 6 is a perspective view showing the components of the clutch of FIG. 5 in disassembled relationship.

As best seen in FIGS. 5 and 6, the clutch component of this invention is formed from a driven cylinder 30 and a driving cylinder 32, each of which carries a plurality of magnets 34 and 36, respectively. Cavities 35 and 38, respectively, are provided in cylinders 30 and 32 to house the magnets 34 and 36. Magnets 34 and 36 are positioned so that the north pole of one of the cylinders faces the south poles of the other cylinder. Thus a strong attraction is provided between cylinders 30 and 32 when the magnets are in alignment.

The cap engaging platen 22 is carried on the lower end of spindle 24. Platen 22 tends to hold the cap on the bottle and, when the bottle and closure device are closely engaged, the platen pushes upward against cap engaging components 25 causing them to pivot tightly around the bottle cap. Spindle 24 passes through central holes 40 and 41 of clutch elements 30 and 32 and is axially movable therein being restrained, however, from downward movement by a nut 52.

Figure 4:
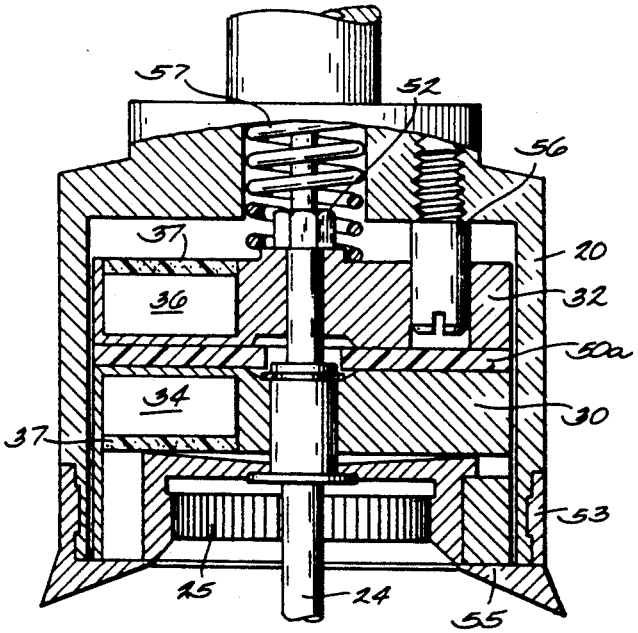
FIG. 4 is a cross-sectional view of a capping head of the type shown in FIG. 2 but with a greater space between the clutch components.

Driving cylinder 32 is provided with drive openings 54 which receive drive pins 56 that are integrally connected to outer housing 20 by being threaded therein as seen in FIG. 4.

The space between driving clutch disk 32 and driven clutch disk 30 is adjusted by means of a nonmagnetic spacer 50 or 50*a*. As noted by comparing FIGS. 2 and 4, the space is increased and the maximum torque provided by the clutch reduced by utilizing thicker spacer 50*a*. The clutch assembly is held within the outer housing 20 by a retainer collar 55, which may be part of a sleeve 53 affixed to housing 20, for example, by spring clips, pins or threads. It is preferred that a spring 57 be provided to urge the clutch assembly downward. The assembly otherwise will tend to remain downward due to gravity, but the spring 57 will tend to overcome any binding effect and is also found to assist in the smooth start up of the driven component 30 of clutch assembly by slightly increasing the frictional engagement between spacer element 50 and the faces of clutch elements 30 and 32. In addition, the spring assists in assuring that complete engagement of the cap 11 with the cap engaging component 25 takes place. The driven element 30 is driven not only by the magnetic forces between it and driving clutch element 32 but also by frictional engagement of the spacer 50 with the top surface of the driven element 30.

The clutch components slip relative to each other after the container cap is sufficiently tightened. It will be seen that when this point is reached after rotation of the threaded caps onto the threaded container necks 13, the driving heads provide only limited torque so that the caps cannot be damaged or overtightened.

For installations intended to be used in milk bottling installations or other food handling and packaging plants, it is desirable that the components of the clutch be formed from a rust resistant material such as stainless steel or plastic. While resin 37 is preferably a cured epoxy, any other similar resin can be substituted. Mechanical closure devices can also be substituted. Disk 50 is preferably formed from a plastic material such as nylon, "Teflon ®", polypropolene, UHMW polyethylene or the like. Other non-magnetic materials, for example, brass, could be substituted if desired. The spacer is preferably of diameter slightly less than that of the clutch cylinders. Also, it is desirable that spacer 50 extends over the majority of the area of the clutch engaging surface.

As seen in FIG. 6, it is preferred to form disk 50 with a slot 58 on one side so that spacer 50 can be changed without disassembling the entire clutch mechanism. Constrictions can be provided on the edges of the slot to enable snapping of the disk over spindle 24 and to thereby subsequently retain disk 50 on spindle 24. Spacer 50 can also be formed without slot 58, if desired. Channels 60 can be provided in the driven clutch cylinder face to provide a means for cleaning, for example, by a pressurized cleaning fluid without disassembly of the clutch. These channels, while being optional, may also somewhat increase the frictional driving force between the lower surface of disk 50 or 50*a* and the upper surface of driven clutch disk 30.

It will be noted that the openings 35 and 38 in the driven and driving clutch disk, respectively, are formed in the side of the disk away from the surfaces that engage disk 50. This arrangement protects the individual magnets 34 and 36 as well as the sealing resin 37. While various types of magnets can be used in connection with the clutch, it is preferred that neodymium-iron-boron permanent magnets be used. Other permanent magnets can also be used. While in the illustrated embodiment four magnets are illustrated as being used in each of the driving and driven clutch elements, other numbers of such magnets can be used, for example, five, eight or twelve magnets in each clutch disk. Also, while round cavities and magnets have been illustrated, other shapes such as square, polygonal, etc. could be used instead.

While the invention has been described in connection with the illustrated specific embodiment, it is to be understood that various modifications and variations will be apparent to those skilled in the art. Accordingly, the invention is intended to embrace all such alternatives, modifications and variations.

The scope of the invention is defined in the claims appended hereto.

What is claimed is:

1. A clutch including a driving component and a driven component adapted for use in a screwcapping device to apply a preselected amount of torque to the driven component thereof comprising a pair of axially aligned circular cylinders of equal diameter each having a generally smooth engaging surface facing the other clutch cylinder of said pair, said pair of cylinders comprising a driving cylinder and a driven cylinder, means to rotate the driving cylinder about its axis, each of said cylinders having a plurality of cavities therein radially spaced around the axis thereof, said cavities containing permanent magnets, means securing said magnets in said cavities, and, a removable non-magnetic spacer disk of a diameter approximately equal to that of said cylinders positioned between and in frictional contact with the engaging surfaces thereof.

2. A clutch according to claim 1 wherein said means for securing said magnets comprises a plug formed of a polymeric material.

3. A clutch according to claim 1 wherein each of said cylinders has a small central opening and an axially movable spindle is located in said openings.

4. A clutch according to claim 3 wherein said removable spacer disk comprises a non-magnetic material and further comprises a center and a periphery and has a slot extending radially from the center to the periphery thereof on one side whereby the disk is adapted to be positioned on said spindle.

5. A clutch according to claim 1 wherein said clutch is of a compact cylindrical configuration adapted to fit within a housing of a screwcapping device configured to hold a mechanical clutch of similar dimensions.

6. A clutch according to claim 1 wherein the north poles of the magnets in one of said cylinders face the engaging surface thereof and the south poles of each of the magnets in the other cylinder face the engaging surface thereof.

7. A clutch according to claim 1 wherein a mechanical spring is provided to urge the driving cylinder downward.

8. A clutch according to claim 1 wherein the driven cylinder is provided with radially arranged grooves in the engaging surface thereof.

9. A clutch adapted for use in a screwcapping device to apply a preselected amount of torque to a driven component thereof comprising a pair of axially aligned circular cylinders of equal diameter each having a generally smooth engaging surface facing the other cylinder of said pair, said pair of cylinders comprising a driving cylinder and a driven cylinder, means to rotate the driving cylinder about its axis, each of said cylinders having a plurality of cavities in a side thereof opposite said engaging surface, said cavities being spaced radially around the axis of said cylinders, said cavities containing magnets, the north poles of the magnets in one of said cylinder facing the engaging surface thereof and the south poles of each of the magnets in the other cylinder face the engaging surface thereof, means securing said magnets in said cavities, and, a removable non-magnetic spacer disk of a diameter slightly less than that of said cylinders positioned between the engaging surfaces thereof, said disk covering the majority of the surface area of the engaging surfaces of said cylinders and being in frictional contact with the engaging surface of each of said cylinders.

10. A clutch according to claim 9 wherein said means for securing sad magnets comprises a plug formed of polymeric material.

11. A clutch according to claim 9 wherein each of said cylinders has a small central opening and an axially movable spindle is located in said openings.

12. A clutch according to claim 11 wherein said removable spacer disk comprises a center and a periphery and comprises a non-magnetic disk having a slot extending radially from the center of the periphery thereof on one side whereby the disk is adapted to be positioned on said spindle.

13. A clutch according to claim 9 wherein a mechanical spring is provided to urge the driving cylinder downward in a screwcapping head.

* * * * *